US006499185B1

(12) United States Patent
Moyer et al.

(10) Patent No.: US 6,499,185 B1
(45) Date of Patent: Dec. 31, 2002

(54) APPARATUS FOR HOLDING A DOOR OPEN

(75) Inventors: David Moyer, Coatesville, PA (US); Todd Beaton, Blandon, PA (US); Ricky Loose, Stevens, PA (US)

(73) Assignee: Dorma Door Controls, Inc, Reamstown, PA (US)

( * ) Notice: Subject to any disclaimer, the term of this patent is extended or adjusted under 35 U.S.C. 154(b) by 116 days.

(21) Appl. No.: 09/699,735

(22) Filed: Oct. 30, 2000

(51) Int. Cl.[7] ..... E05F 5/02
(52) U.S. Cl. ..... 16/51; 16/82; 16/DIG. 17
(58) Field of Search ..... 16/82, 49, 50, 16/51, 54, 66, 68, DIG. 17, DIG. 9, DIG. 10, 83, 85; 292/262, 277, 270; 49/324

(56) References Cited

U.S. PATENT DOCUMENTS 3,144,267 A * 8/1964 Schmid ..... 16/49
3,630,560 A * 12/1971 Atkins et al. ..... 16/49
3,729,770 A * 5/1973 Lasier ..... 16/49
3,771,823 A * 11/1973 Schnarr ..... 16/49
4,286,412 A * 9/1981 Stevens ..... 292/270
4,506,407 A * 3/1985 Downey ..... 16/49
4,750,236 A * 6/1988 Teague, Jr. ..... 16/49
4,878,265 A * 11/1989 Nesbitt ..... 16/49
5,311,642 A * 5/1994 Tillmann et al. ..... 16/DIG. 17

* cited by examiner

*Primary Examiner*—Anthony Knight
*Assistant Examiner*—Doug Hutton
(74) *Attorney, Agent, or Firm*—Reed, Smith LLP

(57) ABSTRACT

A door hold-open device including a track, a first catch slidably mounted for longitudinal movement in the track, a stop assembly including a second catch coupled to the track and adapted to engage the first catch wherein the second catch is moveable in a direction different than the longitudinal direction, a resilient member that applies a force to the second catch to urge the second catch into a position where the second catch engages the first catch when the first catch is adjacent to the second catch, and a linear actuator having a first position and a second position, wherein the linear actuator applies a first force to the resilient member in the first position and a second different force to the resilient member in the second position.

11 Claims, 9 Drawing Sheets

APPARATUS FOR HOLDING A DOOR OPEN

FIELD OF THE INVENTION

The present invention relates to door hold-open devices for use in conjunction with door closers.

BACKGROUND OF THE INVENTION

It is conventional practice to provide doors in public buildings with spring-urged devices for automatically urging and returning doors to their closed positions. In some circumstances, it is desirable to temporarily defeat or overcome the action of the door closer, by providing a hold-open mechanism to maintain the door in its open position. Hold-open mechanisms may be made selectively releasable, often in response to a remote sensor such as a smoke detector. Known door hold-open devices include, for example, those disclosed in U.S. Pat. No. 4,878,265.

Unfortunately, known hold-open devices are designed such that the door to which they are attached cannot be opened beyond the point where the hold-open device engages and holds the door. Thus, for example, if a known hold-open device is set to hold a door open at the 90° position, the door cannot be opened past 90° without damaging the door and/or the hold open-device.

Accordingly, there is a need for door hold-open devices for use in conjunction with door closers that permit the door to which they are coupled to open past the hold-open point.

SUMMARY OF THE INVENTION

The invention is directed to a door hold-open device including a track, a first catch slidably mounted for longitudinal movement in the track, a stop assembly including a second catch coupled to the track and adapted to engage the first catch wherein the second catch is moveable in a direction different than the longitudinal direction, a resilient member that applies a force to the second catch to urge the second catch into a position where the second catch engages the first catch when the first catch is adjacent to the second catch, and a linear actuator having a first position and a second position, wherein the linear actuator applies a first force to the resilient member in the first position and a second different force to the resilient member in the second position.

The invention is also directed to a method for holding a door open comprising the step of providing a track, a first catch slidably mounted for longitudinal movement in the track, a stop assembly comprising: a second catch coupled to the track and adapted to engage the first catch wherein the second catch is moveable in a direction different than the longitudinal direction; a resilient member that applies a force to the second catch to urge the second catch into a position where the second catch engages the first catch when the first catch is adjacent to the second catch, and a solenoid having an energized position and a de-energized position, wherein the solenoid applies a first force to the resilient member in the energized position and a second force to the resilient member in the de-energized position.

BRIEF DESCRIPTION OF THE DRAWINGS

Other objects, features, and advantages of the present invention will become more fully apparent from the following detailed description of the preferred embodiments, the appended claims, and the accompanying drawings in which:

DETAILED DESCRIPTION OF THE PREFERRED EMBODIMENT(S)

Figure 1:
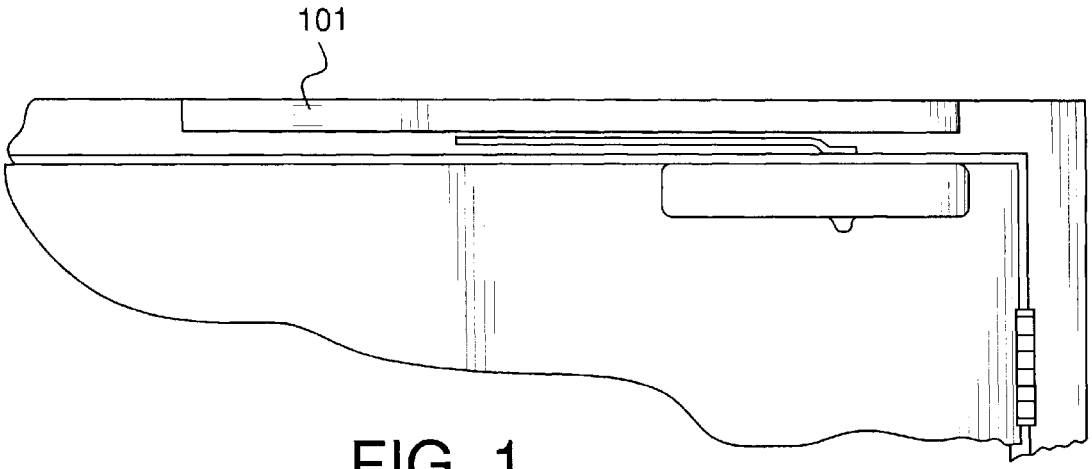
FIG. 1 is a partial elevation view, with portions broken away, of showing apparatus in accordance with the invention mounted on a door and door frame, with the door in a closed position.

Reference will now be made to the drawing(s) wherein like elements are provided with like reference designations. It will be understood that the drawings included herewith only provide diagrammatic representations of a preferred embodiment of the present invention and that elements falling within the scope of the present invention may include elements different than those shown in the drawings.

The present invention comprises a track, a slide block slidably mounted in the track, means for overcomably impeding the movement of the slide block along the track such that the slide block can be moved past the impeding means, and means for varying the force required for the slide block to overcome the impeding means.

Figure 2:
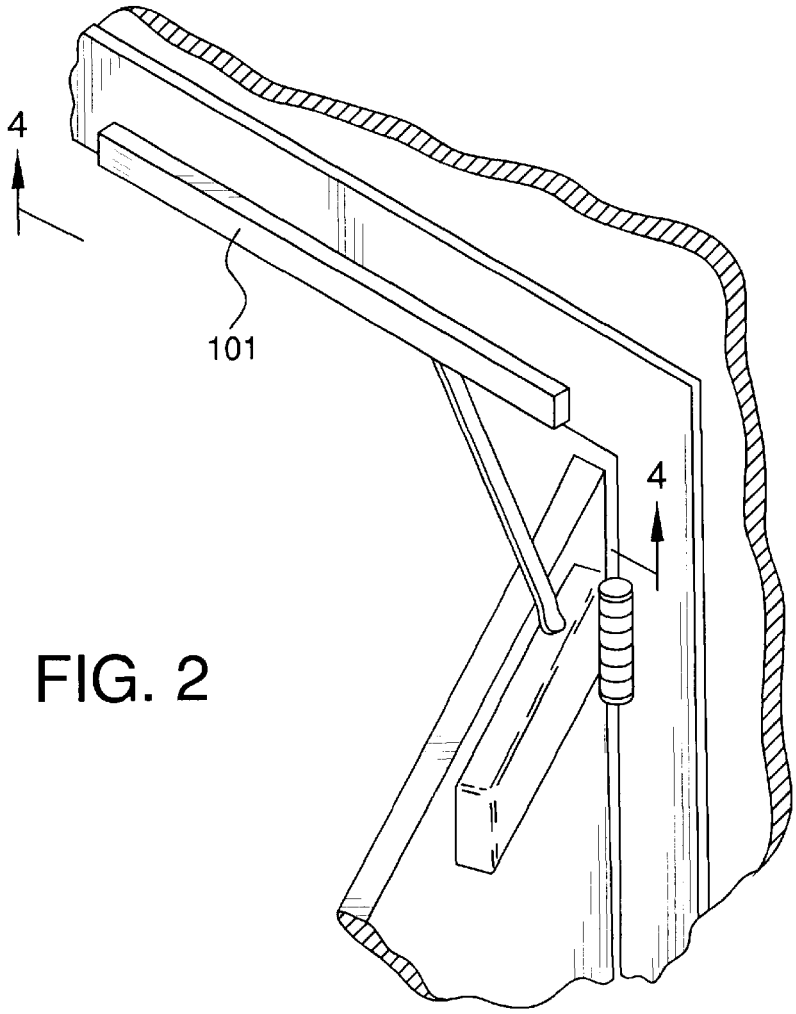
FIG. 2 is a perspective view, also with portions broken away, showing the apparatus on a door and door frame with the door at an open position.
Figure 6:
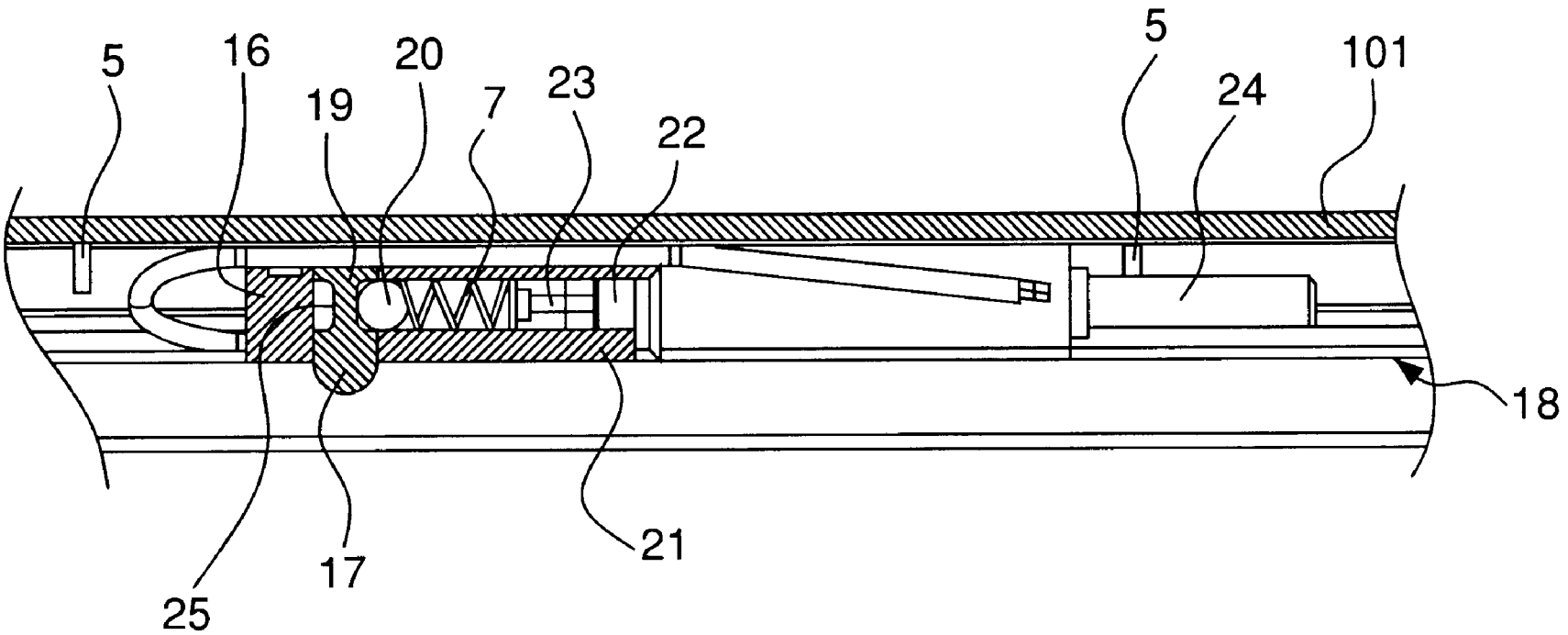
FIG. 6 shows a sectional side view of the stop assembly of FIG. 3.
Figure 7:
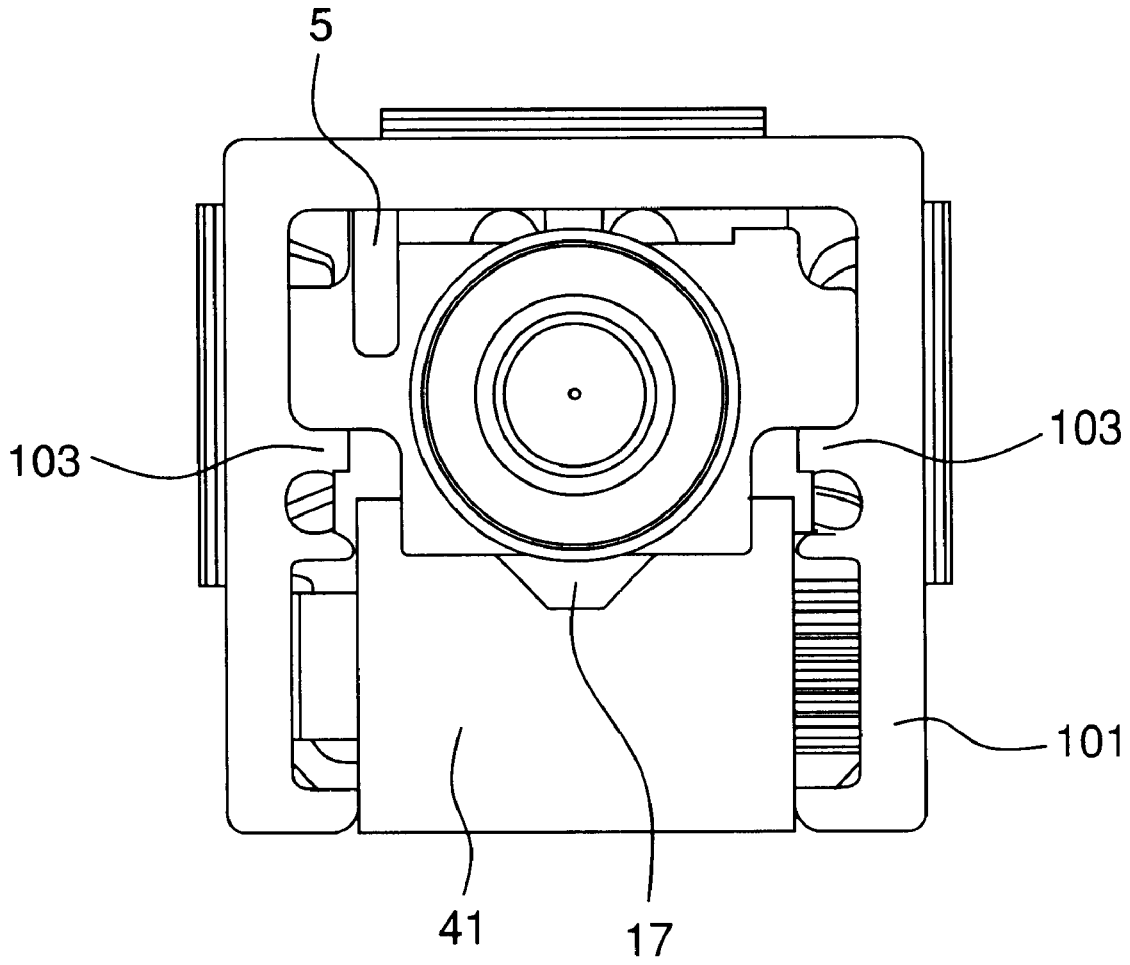
FIG. 7 shows an end view of a partially assembled device according to the present invention.
Figure 8:
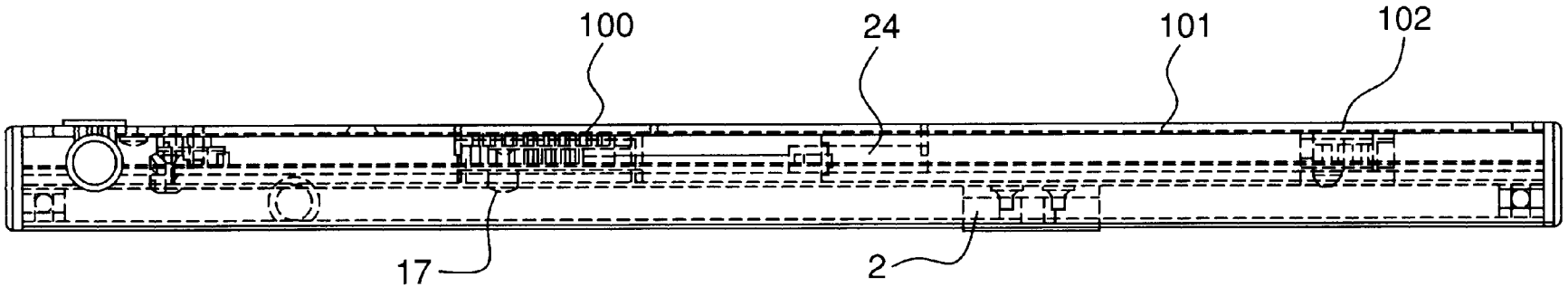
FIG. 8 shows a side view of a fully assembled hold-open device in accordance with a preferred embodiment of the present invention.
Figure 9:
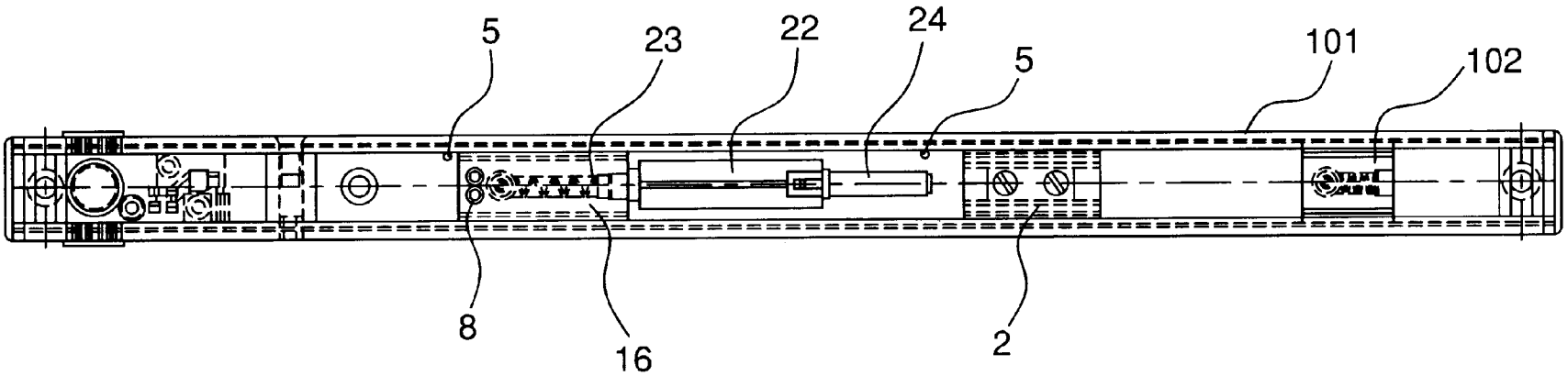
FIG. 9 is a bottom view of the hold-open device of FIG. 8.
Figure 10:
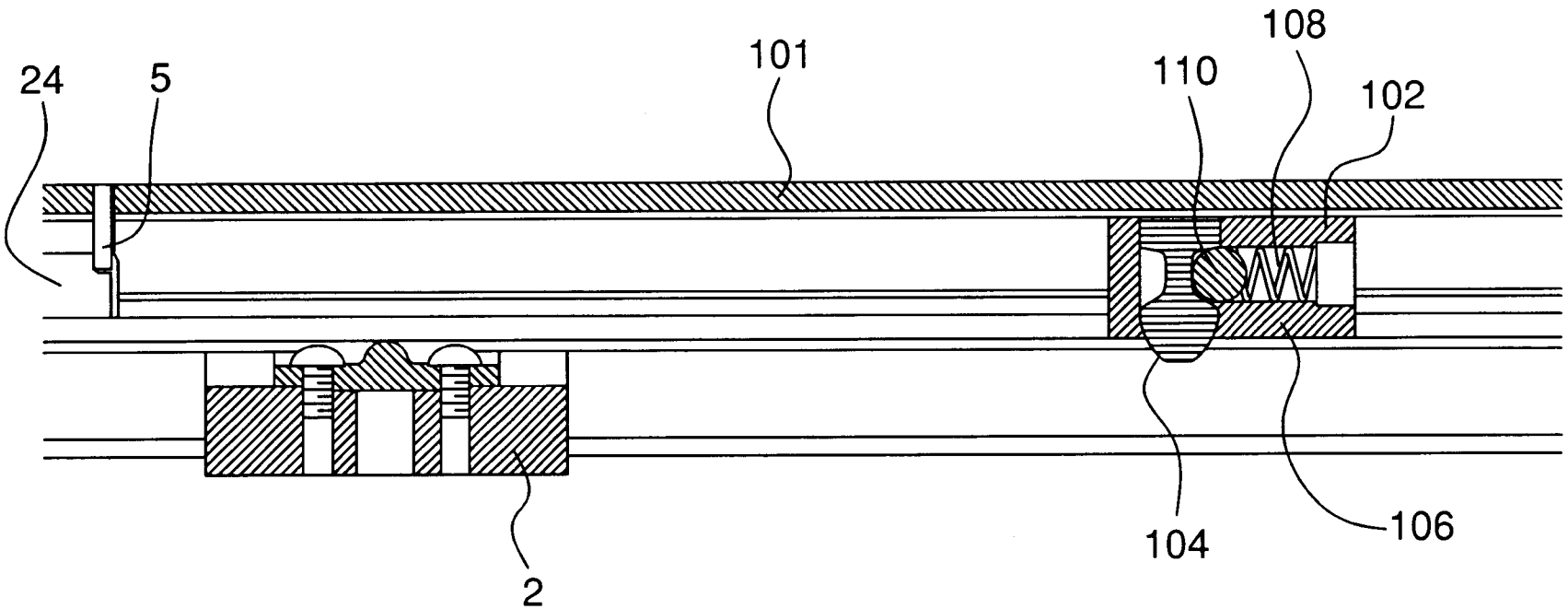
FIG. 10 shows a detail side view of the hold open device of FIG. 3, showing the slide block assembly and reset assembly in greater detail.

Referring now to FIGS. 3–10, there is shown a preferred embodiment of the present invention. The track 101 may be any structure suitable for slidably engaging the slide block 2. In a preferred embodiment, the track 101 is an elongated U-Shaped structure defining a channel. The track is preferably made of aluminum, steel or brass or any other material of sufficient structural strength to house the components as set forth herein. As best shown in FIG. 7, the track may have rails 103 for slidably engaging the slide block 2. The track is adapted to be secured to the frame of a door. The location and orientation of the track on the door frame depends on the type of installation (e.g., push or pull mount), for example, as shown in FIGS. 1 and 2.

Figure 3:
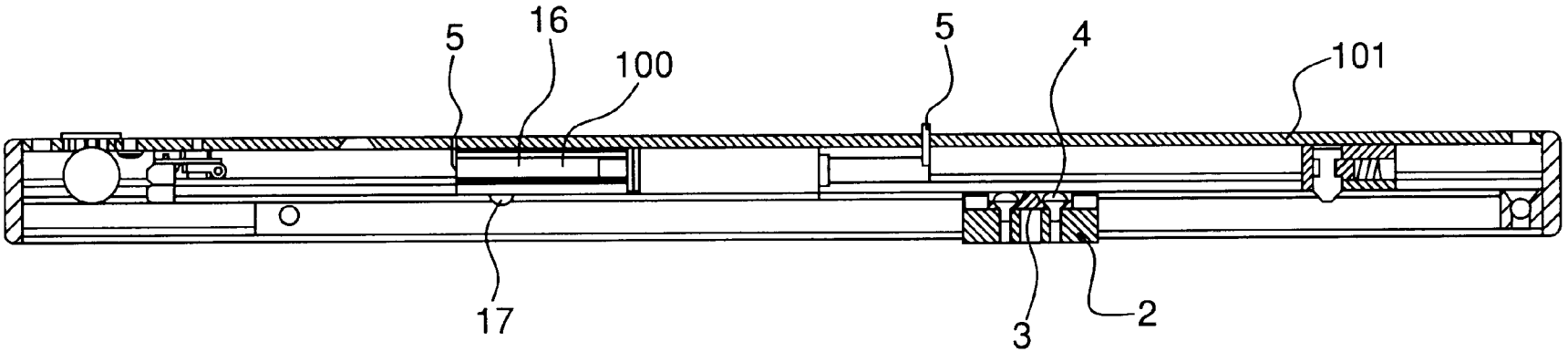
FIG. 3 shows sectional side view of a hold-open device in accordance with a preferred embodiment of the present invention.
Figure 4:
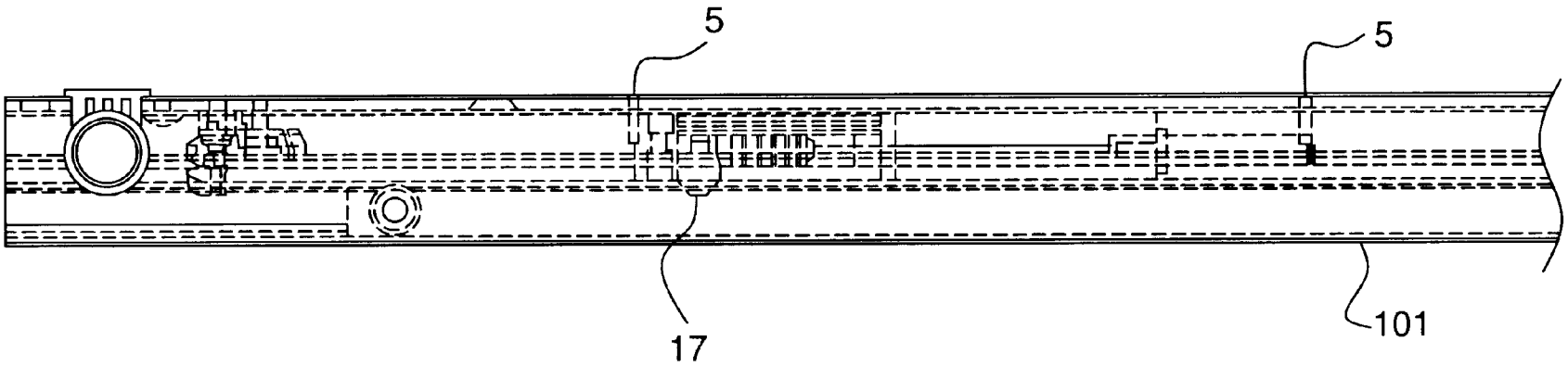
FIG. 4 shows a detail side view of the device of FIG. 3, showing the stop assembly in greater detail.
Figure 5:
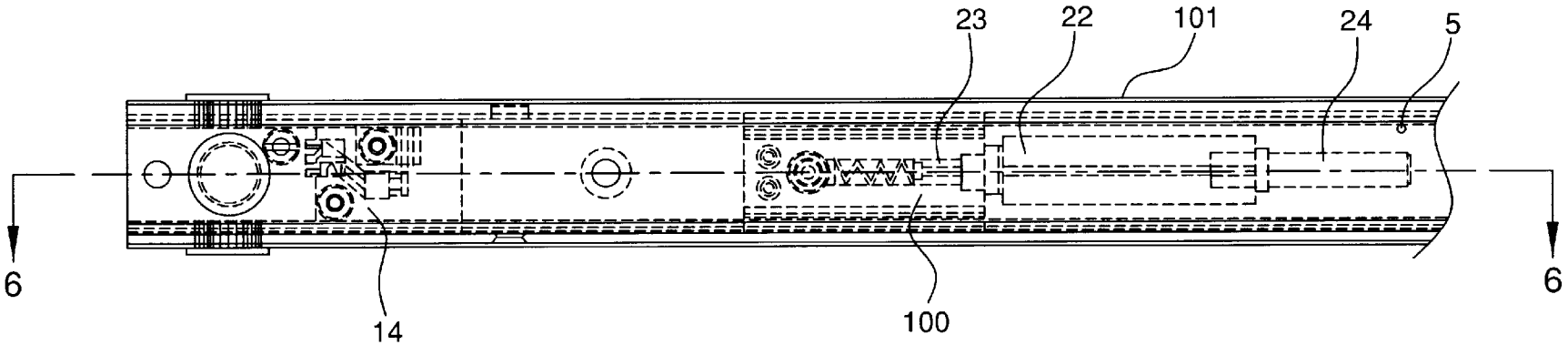
FIG. 5 shows a detail top view of the device of FIG. 3, showing the stop assembly in greater detail.

As shown in FIG. 3, the slide block 2 is slidably mounted in the track 101 such that the slide block can move longitudinally along the length of the track as the door is opened. The slide block 2 has a slide block catch feature 3 which may be any structure adapted to engage a stop assembly catch 17 which is part of the stop assembly. In a preferred embodiment, the slide block catch feature 3 is a convex member that may be secured to the slide block by screws 4, such that the slide block catch feature 3 projects beyond a plane formed by the top surface of the slide block 2. In an alternative embodiment, the slide block catch feature 3 could be integral to the slide block 2. In another alternative embodiment the slide block catch feature 3 could comprise a concave structure adapted to engage a second catch. The slide block 2 and slide block catch feature 3 are preferably made of brass, steel, plastic or any other material of sufficient structural strength to house the components as set forth herein and preferably of a material softer than that of the track to avoid galling.

The stop assembly 100 comprises means for overcomably impeding the movement of the slide block 2 along the track 101. The impeding means impedes the movement of the slide block 2 at a point along the track 101 but can be overcome by the application of a predetermined amount of force to the door to which the slide block 2 is coupled at a specific distance from the hinge of the door (a "threshold force") sufficient to overcome the impediment such that upon application of the threshold force, the slide block moves past the impeding means along the track. The stop assembly may further comprises means for varying the threshold force. The threshold force may be any force suitable for the application, but is preferably 10 to 40 pounds, as measured in accordance with ANSI standard A156.15-1995.

As shown in FIG. 6, the impeding means 16 is stop assembly 100 preferably comprises a stop assembly catch 17 mounted beneath the plane of travel 18 of the slide block 2. The stop assembly catch 17 is preferably mounted on or is part of an extension referred to herein as plunger 19. The plunger 19 is preferably slidably mounted (in a direction different than the direction of travel of the slide block 2) in the track 101 so that the stop assembly catch 17 can move into and out of the plane of travel of the slide block catch 3 (not shown). Put another way, the stop assembly catch 17 has two positions: (1) an extended position where it engages and/or otherwise impedes the travel of the slide block 2; and (2) a retracted position where it does not engage or otherwise impede the travel of the slide block. In a preferred embodiment, the slide block catch 3 forces the stop assembly catch 17 into the retracted position (not shown) when the threshold force is applied to the slide block 2. The impeding means 16 further comprises a resilient member 7, such as a spring or elastomeric element, positioned and adapted to urge the stop assembly catch 17 into the extended position. The specific resilient member 7 is selected to achieve the threshold force.

In a preferred embodiment, the stop assembly catch 17 is integral to a plunger 19 slidably mounted in the track for travel along a direction orthogonal to the direction of travel of the slide block 2. A side of the plunger 19 is concave shaped 25 to engage a ball 20 or other convex member. The resilient member 7 is a spring [7] that pushes against the ball 20, which, in turn, pushes against the plunger 19. The resilient member 7 and the ball 20 are preferably housed in a block 21 or other member that contains the resilient member 7. In operation, a user opens the door thereby applying a threshold force to the slide block 2. As it passes, this causes the slide block catch feature 3 to engage the stop assembly catch 17 and forces the plunger 19 and stop assembly catch 17 into the retracted position, thereby forcing the ball 16 out of the concave feature 25 of the plunger and thereby compressing the resilient member 7. Thereafter, the slide block is free to travel beyond the stop assembly catch 17 down any remaining length of the track 101 allowing the door to open further. When the user releases the door, the attached closer (shown in FIG. 2) applies a closing or return force to the door (shown in FIG. 2) which results on a closing or return force on the slide block 2 that is less than the threshold force. As a result, the stop assembly catch 17 impedes the travel of the slide block and holds the door in the open position.

The stop assembly may further comprise means for varying the threshold force. The means for varying the threshold force comprises means for varying the force applied by the resilient means on the stop assembly catch 17. The varying means is also preferably electronically controllable. In a preferred embodiment, the varying means comprises a linear actuator, such as a solenoid or a hydraulic or air cylinder. As shown in FIG. 6, the solenoid 22 drives a piston 23 which compresses the resilient member 7. In the preferred embodiment, when the solenoid 22 is energized, the piston 23 is extended, the resilient member 7 is relatively compressed and the stop assembly catch 17 will hold the door open against the force of the door closer. When the solenoid 22 is de-energized the piston 23 is retracted, the resilient member 7 is relatively uncompressed and the stop assembly catch 17 will not hold open the door against the force of the door closer. Alternatively, the door may be closed manually without de-energizing the solenoid by manually exceeding the hold-open threshold force.

In a preferred embodiment, the stop assembly may further comprise a standoff 24 that extends past the pin 5 on the solenoid side of the stop assembly and is adapted to engage the reset assembly 102 (shown in FIG. 8) and enable the reset assembly to reset the solenoid.

When the door is closed by de-energizing the solenoid, the reset assembly 102 (best known in FIG. 10) serves to reset the solenoid 21 when the door is re-opened. The reset assembly 102 comprises a reset assembly catch 104 that is slidable along the track 101 in the same direction as the slide block 2. The reset assembly catch 104 is adapted to engage the slide block catch 3 in the same manner as the stop assembly catch 17. In a preferred embodiment, the reset assembly catch 104 may be identical to the stop assembly catch 17. Like the stop assembly catch 17, the reset assembly catch 104 is contained in a housing 106 for slidable movement in a direction parallel to that of the slide block 2. The reset assembly catch 104 is urged into the plane of travel of the slide block catch 3 by the combination of a resilient member 108, preferably a spring, and a ball 110. In operation, when the solenoid 22 is de-energized and the door closes, the slide block 2 travels to the end of the track 101 with sufficient force to pass the reset assembly catch 104. When the door is then reopened, the slide block catch 3 engages the reset assembly catch 104 and causes the reset assembly 102 to slide along the track with the slide block 2 until the reset assembly 102 reaches the standoff 24. As the slide block is forced along the track 101 the reset assembly 102 presses against the standoff 24 thereby resetting the solenoid 22. When a sufficient force is applied to the slide block, the slide block catch 3 forces the reset assembly catch 104 to retract thereby releasing the reset assembly and permitting the slide block 2 to travel further along the track as the door opens.

As shown in FIG. 1, the entire stop assembly 100 is preferably movable along the track 101 in the same direction as the slide block 2 to allow the stop assembly catch 17 to be moved to the desired hold-open position. The movement of the stop assembly within the track may be preferably contained by pins 5. The stop assembly 100 may be secured to the desired position in the track by set screws 8 (shown in FIG. 9). The stop assembly 100 may be placed in any desired location in the track within the boundaries established by the pins 5 to enable any desired hold-open range. In a preferred embodiment, the hold-open range is between about 80° and 110°.

In a preferred embodiment, the solenoid is connected to an AC power source through a rectifier board 14 for converting AC power to DC power. The solenoid 22 is also electronically coupled to a controller for selectively energizing and de-energizing the solenoid 22. The controller (not shown) may be any type of manual or automatic control switch. In one embodiment, the controller is a smoke detector. In another embodiment, the controller is a computer that may be coupled to as many door hold-open devices desired.

A hold-open device in accordance with the present invention may further comprise a cover 41 (shown in FIG. 7) for concealing the components in the track.

It will be understood by persons skilled in the art that various changes in the details, components, steps, and arrangements of the components and steps which have been described and illustrated in order to explain the nature of this invention may be made by those skilled in the art without departing from the principle and scope of the invention as expressed in the following claims.

What is claimed is:

1. A door hold-open device comprising:

a. a track;

b. a slide block catch feature slidably mounted for longitudinal movement in the track;

c. a stop assembly comprising:

i. a stop assembly catch coupled to the track and adapted to engage the slide block catch feature wherein the stop assembly catch is moveable in a direction different than the longitudinal direction, ii. a resilient member that applies a force to the stop assembly catch to urge the stop assembly catch into a position where the stop assembly catch engages the slide block catch feature when the slide block catch feature is adjacent to the stop assembly catch;

d. a linear actuator having a first position and a second position, wherein the linear actuator applies a first force to the resilient member in the first position and a second different force to the resilient member in the second position;

wherein said slide block catch feature is free to travel beyond said stop assembly catch along at least a substantial portion of any remaining length of said track, thus allowing a door to open beyond said stop assembly.

2. The device of claim 1, wherein the linear actuator is a solenoid.

3. The device of claim 1 further comprising a reset assembly coupled to the track and comprising a reset assembly catch adapted to engage the slide block catch feature wherein the reset assembly is moveable in the longitudinal direction and wherein the reset assembly contacts the linear actuator when the door is opened and thereby resets the linear actuator.

4. The device of claim 3, wherein the linear actuator is a solenoid and the stop assembly further comprises a ball and stop assembly catch has a concave shaped feature adapted to engage the ball and the ball is positioned between the concave shape feature and the resilient member.

5. The device of claim 1 wherein the stop assembly further comprises a ball and the stop assembly catch has a concave shaped feature adapted to engage the ball and the ball is positioned between the concave shared feature and the resilient member.

6. A door hold-open device comprising:

a. a track;

b. a slide block catch feature slidably mounted in the track;

c. means for overcomably impeding the movement of the slide block catch feature along the track such that the slide block catch feature can be moved past the impeding means;

d. means for varying the force required for the slide block catch feature to overcome the impeding means.

7. A door hold-open device for holding a door open comprising:

a. a track;

b. a slide block catch feature slidably mounted for longitudinal movement in the track;

c. a stop assembly comprising:

i. a stop assembly catch coupled to the track and adapted to engage the slide block catch feature wherein the stop assembly catch is moveable in a direction different than the longitudinal direction;

ii. a resilient member that applies a force to the stop assembly catch to urge the stop assembly catch into a position where the stop assembly catch engages the slide block catch feature when the slide block catch feature is adjacent to the stop assembly catch;

iii. means for applying a variable force to the resilient member and thereby varying the force applied to the stop assembly catch;

wherein said slide block catch feature is free to travel beyond said stop assembly catch along at least a substantial portion of any remaining length of said track, thus allowing a door to open beyond said stop assembly.

8. A method for holding a door open comprising the step of providing a track, a slide block catch feature slidably mounted for longitudinal movement in the track, a stop assembly comprising: a stop assembly catch coupled to the track and adapted to engage the slide block catch feature wherein the stop assembly catch is moveable in a direction different than the longitudinal direction and further wherein said slide block catch feature is free to travel beyond said stop assembly catch along at least a substantial portion of any remaining length of said track, thus allowing a door to open beyond said stop assembly; a resilient member that applies a force to the stop assembly catch to urge the stop assembly catch into a position where the stop assembly catch engages the slide block catch feature when the slide block catch feature is adjacent to the stop assembly catch, and a solenoid having an energized position and a de-energized position, wherein the solenoid applies a first force to the resilient member in the energized position and a second force to the resilient member in the de-energized position.

9. A door hold-open device comprising:

a. a track;

b. a first catch slidably mounted for longitudinal movement in the track;

c. a stop assembly comprising:

i. a second catch coupled to the track and adapted to engage the first catch wherein the second catch is moveable in a direction different than the longitudinal direction;

ii. a resilient member that applies a force to the second catch to urge the second catch into a position where the second catch engages the first catch when the first catch is adjacent to the second catch;

e. a linear actuator having a first position and a second position, wherein the linear actuator applies a first force to the resilient member in the first position and a second different force to the resilient member in the second position; and f. a reset assembly coupled to the track, said reset assembly comprising a third catch adapted to engage the first catch wherein the reset assembly is moveable in the longitudinal direction and wherein the reset assembly contacts the linear actuator when the door is opened and thereby resets the linear actuator.

10. The device of claim 9, wherein the linear actuator is a solenoid and the stop assembly further comprises a ball and the second catch has a concave shaped feature adapted to engage the ball and the ball is positioned between the feature and the resilient member.

11. A door hold-open device comprising:

a track;

a first catch slidably mounted for longitudinal movement in the track;

a stop assembly comprising a second catch coupled to the track and adapted to engage the first catch wherein the second catch is moveable in a direction different than the longitudinal direction, and a resilient member that applies a force to the second catch to urge the second catch into a position where the second catch engages the first catch when the first catch is adjacent to the second catch; and a linear actuator having a first position and a second position, wherein the linear actuator applies a first force to the resilient member in the first position and a second different force to the resilient member in the second position;

wherein the stop assembly further comprises a ball and the second catch has a concave shaped feature adapted to engage the ball and the ball is positioned between the feature and the resilient member.

* * * * *